US011377128B2

(12) United States Patent
Hengstenberg et al.

(10) Patent No.: US 11,377,128 B2
(45) Date of Patent: Jul. 5, 2022

(54) VEHICLE DOOR LEAF FRAME AND VEHICLE DOOR LEAF, FOR EXAMPLE FOR A RAIL VEHICLE

(71) Applicant: SIEMENS MOBILITY GMBH, Munich (DE)

(72) Inventors: Thomas Hengstenberg, Groebenzell (DE); Herbert Kammerloher, Biburg (DE); Thomas Langenbacher, Mering (DE); Thomas Wimberger, Freising (DE)

(73) Assignee: Siemens Mobility GmbH, Munich (DE)

( * ) Notice: Subject to any disclaimer, the term of this patent is extended or adjusted under 35 U.S.C. 154(b) by 282 days.

(21) Appl. No.: 16/652,241

(22) PCT Filed: Sep. 26, 2018

(86) PCT No.: PCT/EP2018/076175

§ 371 (c)(1),
(2) Date: Mar. 30, 2020

(87) PCT Pub. No.: WO2019/063642

PCT Pub. Date: Apr. 4, 2019

(65) Prior Publication Data

US 2020/0239040 A1 Jul. 30, 2020

(30) Foreign Application Priority Data

Sep. 29, 2017 (DE) ..... 10 2017 217 359.9

(51) Int. Cl.
*B61D 19/02* (2006.01)
*B61D 23/00* (2006.01)
(Continued)

(52) U.S. Cl.
CPC ..... *B61D 19/02* (2013.01); *B61D 23/00* (2013.01); *E05Y 2900/51* (2013.01);
(Continued)

(58) Field of Classification Search
CPC ..... B61D 19/02; B61D 23/00; E05Y 2900/51; E05Y 2900/531; E06B 3/7015;
(Continued)

(56) References Cited

U.S. PATENT DOCUMENTS 3,375,030 A * 3/1968 Thompson ..... E06B 3/9684 403/231
3,561,801 A * 2/1971 Chiu ..... F16B 7/0446 403/264
(Continued)

FOREIGN PATENT DOCUMENTS

CN 2487585 Y 4/2002
CN 104768826 A 7/2015
(Continued)

*Primary Examiner* — Mark T Le
(74) *Attorney, Agent, or Firm* — Laurence A. Greenberg; Werner H. Stemer; Ralph E. Locher

(57) ABSTRACT

A vehicle door leaf frame, in particular a rail vehicle door leaf frame, preferably for an inwardly opening vehicle door leaf for an entry door. The vehicle door leaf frame has a plurality of, in particular precisely four, hollow frame profiles constituting the actual vehicle door leaf frame. The hollow frame profiles are produced from a plurality of, in particular precisely two, different hollow profiles. In an alternative embodiment, a vehicle door leaf, in particular a rail vehicle door leaf, preferably an inwardly opening vehicle door leaf for an entry door, has a vehicle door leaf frame and is itself pressure-tight and/or water-tight.

7 Claims, 3 Drawing Sheets

(51) Int. Cl.
*E06B 3/70* (2006.01)
*E06B 3/76* (2006.01)

(52) U.S. Cl.
CPC ..... *E05Y 2900/531* (2013.01); *E06B 3/7015* (2013.01); *E06B 3/76* (2013.01)

(58) Field of Classification Search
CPC ..... E06B 3/76; E06B 3/70; E06B 2003/7059; E06B 2003/7074; E06B 2003/7082; E06B 2003/709; E06B 2003/7092
See application file for complete search history.

(56) References Cited

U.S. PATENT DOCUMENTS

| | | | | |
|---|---|---|---|---|
| 3,816,011 | A * | 6/1974 | Biebuyck | F16B 7/187 403/187 |
| 5,924,259 | A * | 7/1999 | Marousek | E04F 19/06 52/656.1 |
| 9,963,923 | B2 | 5/2018 | Jetzinger et al. | |
| 2014/0290529 | A1* | 10/2014 | Tazreiter | B61D 25/00 105/396 |
| 2015/0113904 | A1* | 4/2015 | Sprague | E06B 3/70 52/656.9 |

FOREIGN PATENT DOCUMENTS

| | | | |
|---|---|---|---|
| CN | 107187066 | A * | 9/2017 |
| DE | 2114109 | A1 | 10/1972 |
| DE | 9408079 | U1 | 7/1994 |
| DE | 102012107422 | A1 | 2/2014 |
| EP | 2006135 | A2 | 12/2008 |
| EP | 2799305 | A2 | 11/2014 |

* cited by examiner

VEHICLE DOOR LEAF FRAME AND VEHICLE DOOR LEAF, FOR EXAMPLE FOR A RAIL VEHICLE

BACKGROUND OF THE INVENTION

Field of the Invention

The invention relates to a vehicle door leaf frame, in particular a rail vehicle door leaf frame, preferably for an inwardly opening vehicle door leaf for an entry door. Furthermore, the invention relates to a vehicle door leaf, in particular to a rail vehicle door leaf, preferably to an inwardly opening vehicle door leaf for an entry door. Furthermore, the invention relates to a vehicle, in particular to a rail vehicle, preferably to a locomotive.

A known rail vehicle door leaf has substantially a welded rail vehicle door leaf frame (consisting of four frame profiles which are manufactured from a single, original profile, and four corner connecting parts which are produced in a complex manner) and an adhesively bonded outer plate. Here, in each case two frame profiles which meet are welded to one another via a common corner connecting part. For this reason, a manufacturer of a rail vehicle door leaf of this type has to be able to demonstrate correspondingly high quality and therefore comparatively expensive qualifications for welding and adhesive bonding (pressure-tightness of the rail vehicle door leaf). Furthermore, the rail vehicle door leaf frame which is constituted as a result comprises, apart from the outer plates, eight components, of which the corner connecting parts are comparatively expensive.

SUMMARY OF THE INVENTION

It is an object of the invention for it to be possible for the manufacturing costs for a rail vehicle to be lowered comparatively quickly in the region of a rail vehicle door, without it being necessary in the process for a construction of the rail vehicle to be affected excessively deeply. Since interference in a rail vehicle door frame cannot be implemented quickly, the costs in the region of a rail vehicle door leaf are to be lowered; a functionality of the rail vehicle door leaf and therefore of the rail vehicle door is to remain at least constant.

The object of the invention is achieved by means of a vehicle door leaf frame, in particular a rail vehicle door leaf frame, preferably for an inwardly opening vehicle door leaf for an entry door; by means of a vehicle door leaf, in particular a rail vehicle door leaf, preferably an inwardly opening vehicle door leaf for an entry door, and by means of a vehicle, in particular a rail vehicle, preferably a locomotive, such as a freight train locomotive, for example. Advantageous developments, additional features and/or advantages of the invention result from the dependent patent claims and/or the following description of the invention.

The vehicle door leaf frame according to the invention has a plurality of (in particular, four or precisely four) frame hollow profiles which constitute the actual vehicle door leaf frame, the frame hollow profiles being produced from a plurality of (in particular, precisely two) different original hollow profiles or proto-hollow profiles. Here, in all the embodiments of the invention, one, a plurality of or all the frame hollow profiles can be substituted by one or more frame profiles. Frame hollow profiles which meet one another can be plugged and/or fitted into one another in a corner region of the vehicle door leaf frame. It is preferred here for the frame hollow profiles which meet one another to be plugged and/or fitted into one another in all four corner regions.

Furthermore, frame hollow profiles which meet one another in a corner region of the vehicle door leaf frame can be riveted and/or screwed and/or connected by way of another joining method to one another, the functional principle of which other joining method is based on doubling up of sheet metal. It is preferred here to rivet and/or to screw the frame hollow profiles which meet one another to one another in all four corner regions. In one embodiment, seal edges which meet one another of frame hollow profiles which meet one another can be substantially flush among one another in the circumferential direction of the vehicle door leaf frame. As a result, at least one completely circumferential door seal and/or one completely circumferential window seal can be realized.

In one embodiment, the frame hollow profiles can comprise two or, in particular, precisely two inner frame hollow profiles, and two or, in particular, precisely two outer frame hollow profiles. Here, the inner frame hollow profiles can be of substantially homogeneous (in the sense of identical) configuration, and/or the outer frame hollow profiles can be of substantially homogeneous (in the sense of identical) configuration. Here, a longitudinal end section of a base profile (see below) of an inner frame hollow profile can be received between two side walls of an outer frame hollow profile.

Here, the relevant longitudinal end section of the base profile (machined, preferably stepped) of the inner frame hollow profile, in particular without at least one section of a profile web and/or without at least one section of a profile limb, can be received in each case between two relevant side walls of the relevant outer frame hollow profile which lie opposite one another, the base profile of the inner frame hollow profile preferably being seated mainly or substantially on a relevant base profile of the outer frame hollow profile. Here, apart from fastening means, the relevant longitudinal end section of the inner frame hollow profile is blocked in at least two, preferably in three, translational directions, and is preferably received partially in a positively locking manner in the relevant longitudinal end section of the outer frame hollow profile.

In one embodiment, profile webs which meet one another and/or profile limbs which meet one another of the frame hollow profiles can be substantially flush in the circumferential direction of the vehicle door leaf frame. That is to say, all profile webs which meet one another of the frame hollow profiles lie in each case substantially in one plane. Here, all the radially outer, front profile webs and all the radially inner, front profile limbs can lie substantially in one plane. Furthermore, profile webs which meet one another and/or profile limbs which meet one another of frame hollow profiles which meet one another can be fitted in a mechanical contact region.

In one embodiment, an individual frame hollow profile or the two frame hollow profiles which meet can have a radius in a corner region of the vehicle door leaf frame. The radius serves to guide the respective seal around on/in the vehicle door leaf frame. In accordance with the invention, two different frame hollow profiles are preferably plugged into one another, are preferably fitted and are preferably riveted, no offset being produced at the radii. The respective radius can serve as a plug-in lug for a seal, in particular a plug-on seal. Furthermore, the outer frame hollow profiles can substantially have the radii for at least one door seal.

Furthermore, all the frame hollow profiles can constitute the radii for a window seal in the regions which meet one another.

In one embodiment, all the radially outer and front profile webs of the frame hollow profiles can have a substantially completely circumferential seal edge for a front door seal. Furthermore, all the radially outer and rear profile webs of the frame hollow profiles can have a substantially completely circumferential seal edge for a rear door seal. Furthermore, all the radially inner and front profile limbs of the frame hollow profiles can have a substantially completely circumferential seal edge for a window seal.

Moreover, at least one outer and/or at least one inner seal edge of the frame hollow profiles can have grooving. That is to say, a plurality of or all the outer seal edges and/or a plurality of or all the inner seal edges can have grooving. In one embodiment, the vehicle door leaf frame is configured as a completely circumferential profile frame. Moreover, the original hollow profiles or the frame hollow profiles are preferably extruded.

In one embodiment, the two horizontal frame hollow profiles are of substantially mirror-symmetrical configuration with respect to one another in substantially all the sectional planes of the vehicle door leaf frame, and/or are set up in the vehicle door leaf frame, the sectional planes being defined by a width axis and a vertical axis of the vehicle door leaf frame. This can apply analogously to the vertical frame hollow profiles. In one embodiment of the invention, the rough vehicle door leaf frame (for example, apart from fastening devices (through holes for thrust plate, center strut, etc.), a recess for a lock device, a bearing device, a material removed portion, etc.) can be of rotationally symmetrical configuration by approximately 180° with regard to its thickness axis; this can apply analogously to the horizontal and/or vertical frame hollow profiles. Furthermore, the rough vehicle door leaf frame can be of substantially point-symmetrical configuration in substantially all sectional planes which are defined by its width axis and its vertical axis.

The vehicle door leaf according to the invention has a vehicle door leaf frame according to the invention (see above). The vehicle door leaf can have a preferably beaded thrust plate at least on one side and/or a possibly beaded center strut at least on one side. Here, the thrust plate and/or the center strut can be set up between the vertical frame hollow profiles of the vehicle door leaf frame. That is to say, the vehicle door leaf can have a preferably beaded thrust plate and/or a center strut on both sides, that is to say also on an inner side in addition to an outer side.

In one embodiment, the thrust plate and/or the center strut are/is riveted, welded and/or connected by way of another joining method to a frame hollow profile at least on one side, the functional principle of which other joining method is based on doubling up of sheet metal. That is to say, the thrust plate and/or the center strut can be welded, screwed and/or connected by way of another joining method on both sides to the frame hollow profiles, the functional principle of which other joining method is based on doubling up of sheet metal. Moreover, the thrust plate can be riveted, screwed and/or connected by way of another joining method to the third frame hollow profile which meets it, the functional principle of which other joining method is based on doubling up of sheet metal.

The center strut can be configured in one piece, in one piece in material terms, or integrally with the thrust plate. Furthermore, sealing compound can be provided between the thrust plate and/or the center strut, and at least one frame hollow profile. That is to say, sealing compound can be provided between the thrust plate and/or the center strut and the two frame hollow profiles. Sealing mass can of course likewise be provided between the thrust plate and the abovementioned third frame hollow profile. Here and also in the following text, "between" is intended to mean that the sealing compound is provided on one side on a face of a first part and on the other side on an edge of a part, that is to say not as a sandwich consisting of three layers.

In one embodiment, the thrust plate and/or the center strut and at least one frame hollow profile are coated. Furthermore, the center strut can be riveted, screwed and/or connected by way of another joining method to the thrust plate, the functional principle of which other joining method is based on doubling up of sheet metal. Furthermore, sealing compound can be provided between the thrust plate and the center strut. Moreover, the vehicle door leaf frame itself can be of pressure-tight and/or water-tight configuration.—In embodiments, at least one overall (large-area) side, in particular at least the entire outer side, of the vehicle door leaf is coated. Furthermore, the vehicle door leaf can comprise at least one plug-on seal, a stowage shaft window including a mechanism, an interior trim panel, an (external) panel, a recess for a lock device and/or a bearing unit, etc.

The vehicle according to the invention can have a vehicle door leaf frame according to the invention. As an alternative or possibly in addition, the vehicle according to the invention can have a vehicle door leaf according to the invention. The invention can be applied to a rail vehicle (for example, railway vehicle, traction unit, locomotive, end car, power car, self-driving special vehicle for railway tasks, railcar or car (rail vehicle without a dedicated drive), etc.) or a motor vehicle (for example, passenger motor vehicle, passenger transport carriage, bus, ATV (All Terrain Vehicle, off-road/military vehicle), commercial vehicle, (heavy duty) truck, construction vehicle, special vehicle, construction machine, etc.), that is to say vehicles in general (including a wagon, that is to say a general vehicle without a dedicated drive). Furthermore, the invention can be applied to a boat, a ship, an aircraft (means of transportation) or a stationary door.

In accordance with the invention, a series of advantages arise. Considerably lower manufacturing complexity, improved quality, an increase in a functionality, a reduction of demands made of suppliers, a reduction of component diversity and a considerable cost saving arise. In detail, all welding work can be dispensed with, and therefore also work which is necessary for this purpose, such as complicated straightening work and reworking (grinding, filling). Adhesive bonding work is restricted to a small amount, it being possible for a structural adhesive bonding method to be dispensed with (omission of a bonded-on or bonded-in exterior panel and/or a window frame), as a result of which high value adhesive bonding qualification and adhesive bonding documentation are dispensed with. Associated First Article Inspections and welding audits and adhesive bonding audits are in turn dispensed with as a result.

In accordance with the invention, more precise manufacturing tolerances can be achieved than in the case of welding (no welding distortion). Mold costs for cast parts and additional components are dispensed with, with a constant or increased functionality. Moreover, a larger supplier pool for manufacturing the extruded profiles and machining and assembly (riveting, screwing) results than in the case of a welded construction. In accordance with the invention, all corner connection parts are dispensed with by way of the integrated radii and/or plug-in lugs on the frame hollow profiles for the at least one circumferential door seal and the circumferential window seal, no distortion being produced at the plug-in lugs. The sealing compound and/or the coating makes/makes pressure-tightness of the vehicle door leaf possible, even without an exterior panel.

In the following text, the invention is described in greater detail on the basis of exemplary embodiments with reference to the appended diagrammatic drawing which is not true to scale. Sections, elements, components, units, outlines and/or components which have an identical, univocal or analogous configuration and/or function are labeled by way of the same designations in the description of the figures (see below), the list of designations, the patent claims and in the figures (figs.) of the drawing. Furthermore, a possible alternative which is not described in the description of the invention (see above), is not shown in the drawing and/or is not conclusive, a static and/or kinematic reversal, a combination, etc. with respect to the exemplary embodiments of the invention and/or a component, an outline, a unit, a component, an element or a section thereof, can be gathered from the list of designations and/or the description of the figures.

In the case of the invention, a feature (section, element, structural part, unit, component, function, size, etc.) can be either a positive (that is to say, present) or negative (that is to say, absent) configuration, a negative feature not being described explicitly as a feature if importance is not attached in accordance with the invention to the fact that it is absent. A feature of said specification (description, list of designations, patent claims, drawing) can be used not only in an indicated way, but rather also in another way (isolation, combination, replacement, addition, on its own, omission, etc.). In particular, it is possible to replace, add or omit a feature in the patent claims and/or the description on the basis of a designation and a feature which is assigned to the former, or vice versa, in the description, the list of designations, the patent claims and/or the drawing. Moreover, a feature can be interpreted and/or specified in greater detail in a patent claim as a result.

The features of said specification can also be interpreted as optional features (in view of the (usually unknown) prior art); that is to say, each feature can be interpreted as an optional, arbitrary or preferred feature, that is to say as a non-obligatory feature. Thus, it is possible for a feature, possibly including its periphery, to be separated from an exemplary embodiment, it then being possible for said feature to be transferred to a generalized concept of the invention. The absence of a feature (negative feature) in an exemplary embodiment shows that the feature is optional in relation to the invention. Furthermore, in the case of a specific term for a feature, a generic term for the feature can also be inferred (possibly a further hierarchical breakdown into subgenus, section, etc.), as a result of which a generalization of one or said feature is possible, for example with consideration of equivalent technical effect and/or equivalence.

DETAILED DESCRIPTION OF THE INVENTION

Figure 1:
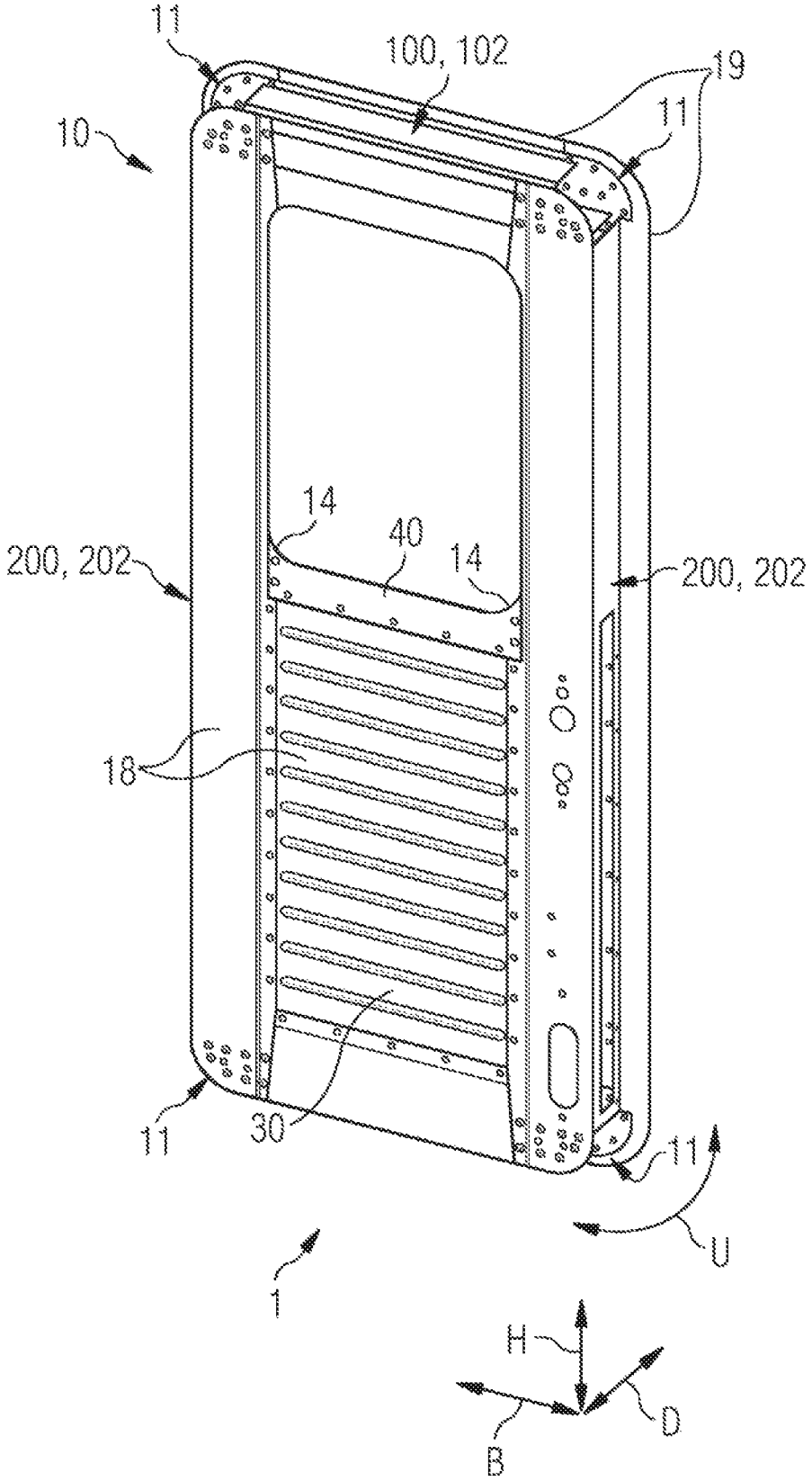
FIG. 1 shows a perspective view of one exemplary embodiment of a vehicle door leaf according to the invention having one exemplary embodiment of a vehicle door leaf frame according to the invention.

The invention is described in greater detail in the following text on the basis of exemplary embodiments of one embodiment of one variant of a vehicle door leaf 1 according to the invention on the basis of a vehicle door leaf frame 10 according to the invention for a rail vehicle (rail vehicle door leaf 1, rail vehicle door leaf frame 10). The invention is not restricted, however, to a variant of this type, to embodiments of this type and/or to the exemplary embodiments which are described in the following text, but rather is of more fundamental nature, with the result that the invention can be applied to all vehicles (see above). The drawing shows only those sections of a subject of the invention which are necessary for a comprehension of the invention.

Furthermore, the description of the invention on the basis of the drawing relates in the following text to a width direction B or a width axis B, to a thickness direction D or a thickness axis D, and to a vertical direction H or a vertical axis H, and to a circumferential direction U of the vehicle door leaf frame 10 or the vehicle door leaf 1. Although the invention has been described and illustrated in greater detail by way of preferred exemplary embodiments, the invention is not restricted by way of the disclosed exemplary embodiments. Other variants can be derived herefrom and/or from the above (description of the invention), without departing from the scope of protection of the invention.

Figure 2:
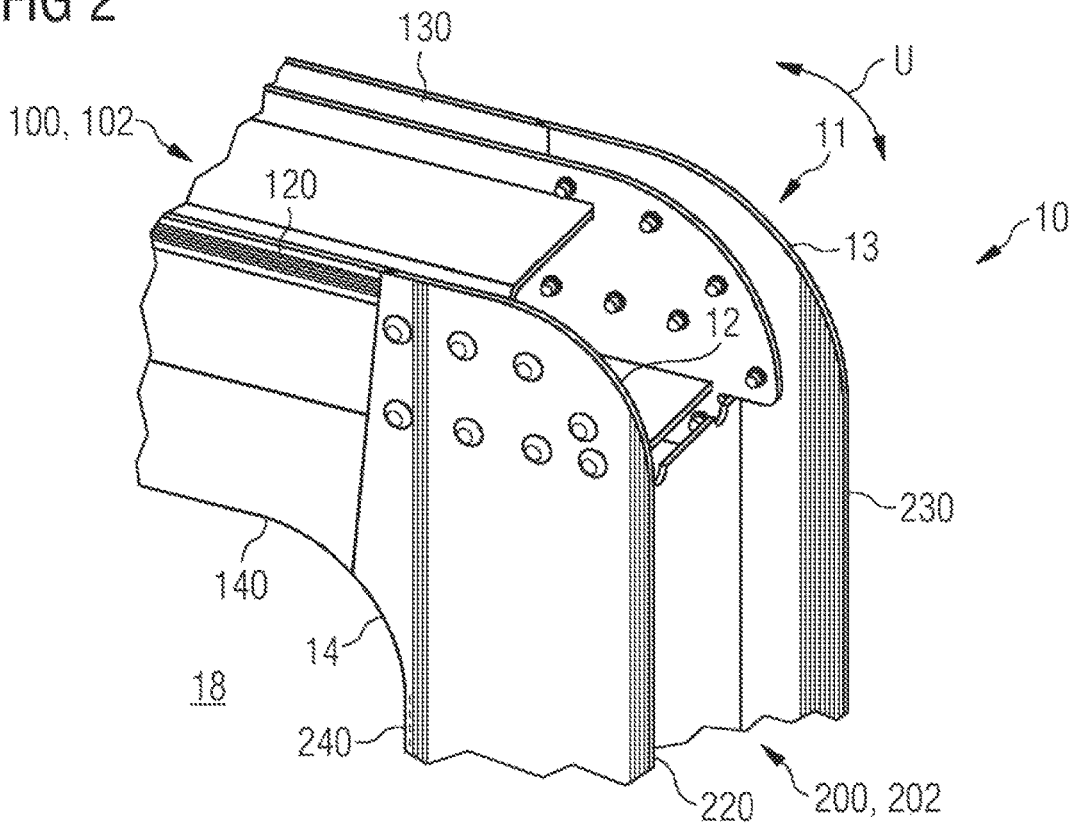
FIG. 2 shows a three-dimensional view, which is more detailed than FIG. 1, of a cut-away, right-hand upper corner region of the vehicle door leaf frame from FIG. 1.

FIG. 1 shows the vehicle door leaf 1, without at least one plug-in seal, a stowage shaft window and a mechanism for the latter, an interior trim panel, an exterior panel, a recess for a lock device and/or a bearing device, etc., based on the vehicle door leaf frame 10, two corner regions 11 of the vehicle door leaf frame 10 being shown in greater detail in FIGS. 2 (right-hand upper corner region 11 of FIGS. 1) and 3 (left-hand upper corner region 11 of FIG. 1). In accordance with the invention, the vehicle door leaf frame 10 is configured as a profile frame 10 which preferably has four frame hollow profiles 102, 102; 202, 202. Another number of frame hollow profiles 102, . . . ; 202, . . . ; . . . can possibly be used.

In accordance with the invention, the frame hollow profiles 102, . . . ; 202, . . . ; . . . come from two or precisely two hollow profiles 100, 200 of different configuration, their cross sections (110, 120, 130, 140; 210, 220, 230, 240; cf., in particular, FIG. 3 with FIG. 4) being of different configuration, in particular, with regard to shape and size. In the present case, two horizontal, inner frame hollow profiles 102, 102 and two vertical, outer frame hollow profiles 202, 202 are used for the vehicle door leaf frame 10. It is of course possible to swap this, that is to say to use vertical, inner frame hollow profiles and horizontal outer frame hollow profiles.

The following comments relate substantially only to a single inner frame hollow profile 102 and a single outer frame hollow profile 202 and a common corner region 11 of said two frame hollow profiles 102, 202. The following comments can be applied analogously, however, to the other frame hollow profiles 102, 202 (preferably two) and the other corner regions 11 (preferably three).

The inner frame hollow profile 102 (cf. FIG. 3) has a base profile 110 with a preferably closed, mainly "rectangular" or mainly "square" cross section. Here, the cross section is "pentagonal", a corner (plan view of the cross section: top left) of a rectangle or square being of beveled configuration (pentagonal, mainly rectangular cross section). That is to say, the base profile 110 is configured as a polygonal tube or a pentagonal tube with a mainly rectangular or square cross section. Here, rounded portions can of course also be provided. Other shapes, such as triangular, hexagonal, polygonal shapes, possibly with rounded portions; round shapes, etc., can of course be used.

Furthermore, the base profile 110 of the inner frame hollow profile 102 preferably has three lug-shaped projections 120, 130, 140 which project away therefrom in the vertical direction H, each projection 120, 130, 140 preferably being configured as an extension of a side wall of the base profile 110, which side wall relates to said projection. All lug-shaped projections 120, 130, 140 preferably do not lie at least with a free section in a plane of that side wall of the base profile 110 which relates to the respective projection 120, 130, 140. Said sections are preferably arranged, however, parallel to the relevant side wall, to which they are preferably connected integrally (parallel offset).

Thus, the base profile 110 has a preferably radially outer, front (outer side 18 of the vehicle) profile web 120 which is preferably recessed substantially completely from the relevant side wall of the base profile 110. The profile web 120 can have a seal edge or can be configured as a seal edge of this type. Said seal edge can have grooving. Furthermore, the base profile 110 has a preferably radially outer, rear (inner side 19 of the vehicle (cab, carbody)) profile web 130 which is preferably recessed merely in sections from the relative side wall of the base profile 110. The profile web 130 can have a seal edge or can be configured as a seal edge of this type. Said seal edge can likewise have grooving.

Moreover, the base profile 110 has a preferably radially inner, front profile limb 140 which is preferably recessed substantially completely from the relevant side wall of the base profile 110. The profile limb 140 can have a seal edge or can be configured as a seal edge of this type. Said seal edge can once again likewise have grooving. The radially outer, front profile web 120 and the radially inner, front profile limb 140 preferably lie in one plane. Here, a respective seal edge serves preferably for receiving a plug-in seal 52, 53, 54 (cf. FIG. 4).

Here, the outer frame hollow profile 202 (cf. FIG. 4) is configured with a substantially analogous shape with respect to the inner frame hollow profile 102, its preferably three lug-shaped projections 220, 230, 240 (radially outer, front profile web 220, radially outer, rear profile web 230, radially inner, front profile limb 240) preferably not projecting from it in the vertical direction H, however, but rather in the width direction B. Furthermore, all lug-shaped projections 220, 230, 240 preferably lie at least with a section, in particular completely, in a plane with that side wall of the base profile 210 which relates to the respective projection 220, 230, 240 and to which they are preferably connected integrally (no parallel offset). Furthermore, the radially outer, front profile web 220 and the radially inner, front profile 240 limb preferably lie in one plane.

Figure 3:
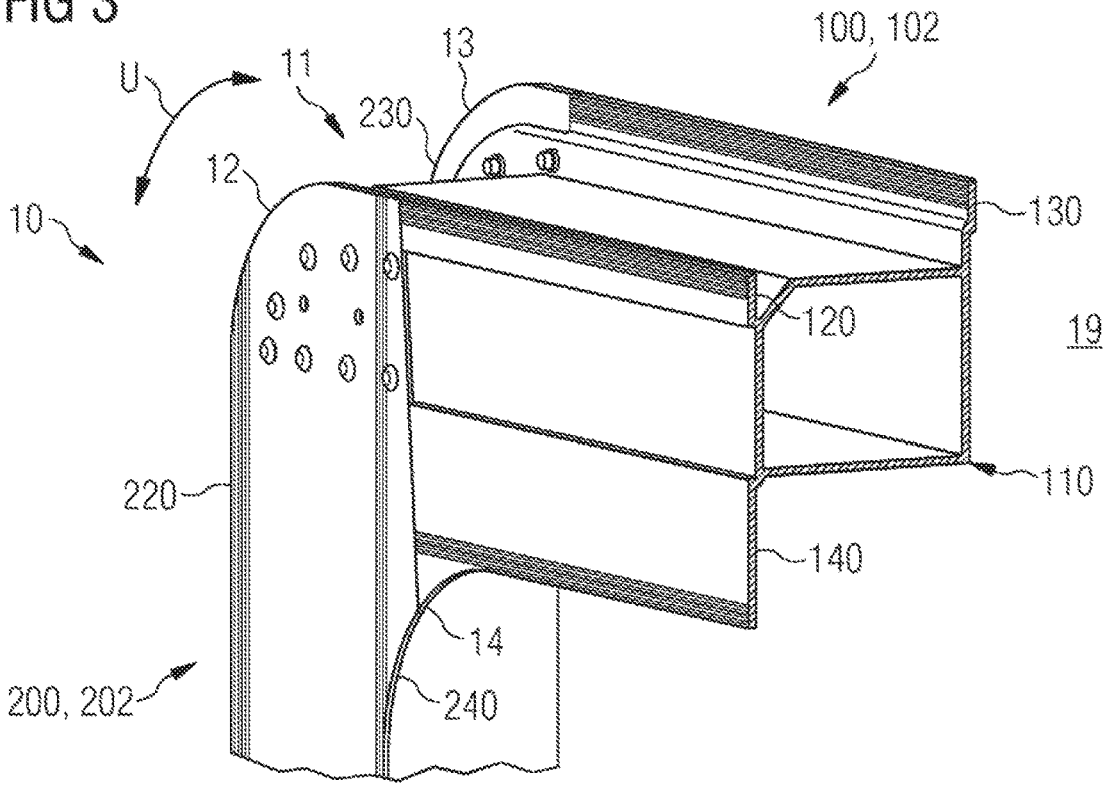
FIG. 3 shows a three-dimensional view, which is more detailed than FIG. 1, of a cut-away, left-hand upper corner region of the vehicle door leaf frame from FIG. 1.
Figure 4:
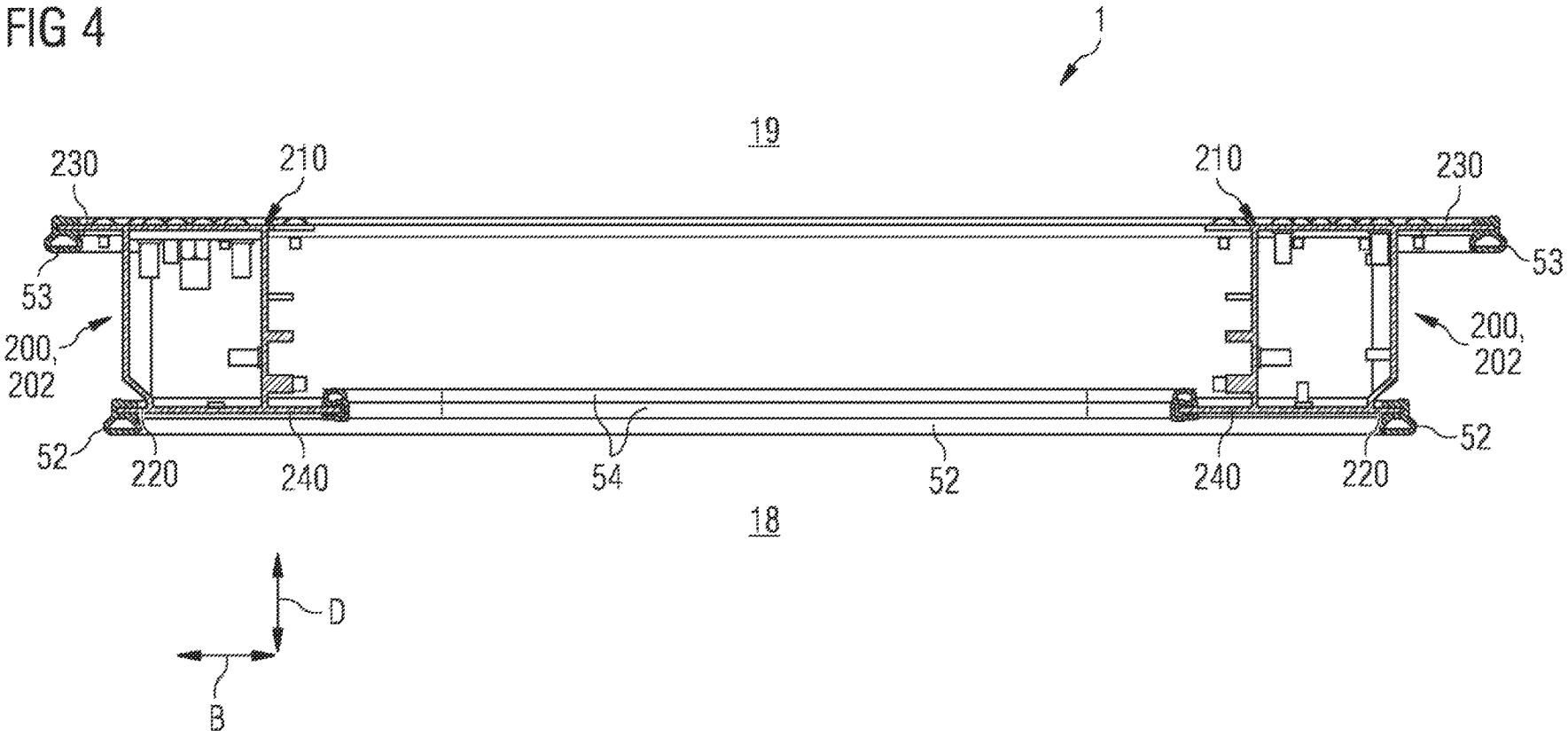
FIG. 4 shows a two-dimensional sectional view of the vehicle door leaf from FIG. 1, the vehicle door leaf being shown sectioned in a region of its cutout for a stowage shaft window.

The outer frame hollow profile 202 is configured in such a way that the base profile 102 of the inner frame hollow 102, possibly including a bonded section, for example, of its outer, rear profile web 130 (cf. FIG. 3), can be received between two side walls of the outer frame hollow profile 202 with a clearance fit or a transition fit (cf. FIGS. 2 and 3). That is to say, the two frame hollow profiles 102, 202 are configured such that they can be plugged into one another with their longitudinal end sections. Said two frame hollow profiles 102, 202 which meet one another can be riveted and/or screwed to one another in their mutual overlaps (corner regions 11). Welded seams/welded spots can possibly be used in addition.

Furthermore, mutual linear contact regions result between the profile webs 120, 220; 130, 230 (four) which meet one another and the profile limbs 140, 240 (two) which meet one another. In said regions, the two frame hollow profiles 102, 202 which meet one another are preferably fitted in a complementary manner, with the result that they configure seal edges which preferably run around substantially completely on the profile webs 120, 220; 130, 230 and have substantially no offset in the thickness direction D. It is possible, in particular, to dispense with one fitted connection or all fitted connections.

The outer frame hollow profile 202 is preferably machined in its two corner regions 11 in such a way that (outer) radii 12, 13 (plug(-in) lugs 12, 13) are provided for the preferably substantially completely circumferential door seals 52, 53 ((plug-in) seals 52, 53). Furthermore, the outer frame hollow profile 202 and, in a corresponding manner thereto, the inner frame hollow profile 102 and, a second time, the outer frame hollow profile 202 and, in a manner which corresponds thereto, a center strut 40 (see below, alternative thrust plate 30, see below) are preferably machined in such a way that radii 14 (plug(-in) lugs 14) are provided there for the preferably substantially completely circumferential window seal 54 ((plug-in) seal 54). The plug-in lugs 12, 13, 14 can have grooving, in order to increase retention of the seals 52, 53, 54.

In order that a (stowage shaft) window can be set up between the outer frame hollow profiles 202, 202, the possibly beaded center strut 40 is riveted and/or screwed onto the two frame hollow profiles 202, 202 at a corresponding level. A preferably beaded thrust plate 30 is riveted or screwed to the two outer frame hollow profiles 202, 202, the center strut 40 and the lower inner frame hollow profile 102 between the center strut 40 and the lower inner frame hollow profile 102. The center strut 40 can possibly be configured in one piece/integrally with the thrust plate 30. In addition or as an alternative to at least one bead, the thrust plate 30 can have at least one other reinforcing device.

In all corner regions 11, a sealing compound can be introduced between the frame hollow profiles 102, 202 which meet one another there during the plugging together, in order that the vehicle door leaf frame 10 can be configured in a pressure-tight manner. The thrust plate 30 and/or the center strut 40 are/is preferably likewise provided with sealing compound on the vehicle door leaf frame 10. Moreover, sealing compound is possibly likewise provided between the thrust plate 30 and the center strut 40. In addition or as an alternative, the transitions between the components which meet one another (frame hollow profiles 102, 102; 202, 202—thrust plate 30—center strut 40) and/or the entire vehicle door leaf frame 10 (possibly on one side, outer side 18 (on the outside and/or on the inside)) can be sealed retroactively, possibly also additionally, with a coating, with the result that the vehicle door leaf 1 is pressure-tight even without an exterior panel.

The invention claimed is:

1. A rail vehicle door leaf frame, comprising:

precisely four frame hollow profiles forming the rail vehicle door leaf frame;

said frame hollow profiles being manufactured from precisely two different hollow profiles;

said frame hollow profiles which meet one another in a corner region of the rail vehicle door leaf frame are plugged into one another;

said frame hollow profiles which meet one another are riveted or screwed to one another in said corner region of the rail vehicle door leaf frame, with a result that a joining method functional principle thereof is based on doubling up of sheet metal;

said frame hollow profiles having precisely two inner frame hollow profiles and precisely two outer frame hollow profiles;

said inner frame hollow profiles being of substantially identical configuration;

said outer frame hollow profiles being of substantially identical configuration;

plug-on seals containing a window seal and door seals including a rear door seal and a front door seal;

two of said frame hollow profiles which meet have a radius in said corner region of the rail vehicle door leaf frame;

said radius serving as a plug-in lug for one of said plug-on seals;

said outer frame hollow profiles have a radii for at least one of the door seals;

all of said frame hollow profiles in regions which meet one another constitute a radii for said window seal;

said frame hollow profiles have radially outer and front profile webs, all of said radially outer and front profile webs have a substantially completely circumferential seal edge for said front door seal;

said frame hollow profiles have radially outer and rear profile webs and all of said radially outer and rear profile webs have a substantially completely circumferential seal edge for said rear door seal;

said frame hollow profiles have radially inner and front profile limbs and all of said radially inner and front profile limbs have a substantially completely circumferential seal edge for said window seal;

said frame hollow profiles have seal edges including at least one outer and at least one inner seal edge with a grooving formed therein; and said seal edges which meet one another of said frame hollow profiles are substantially flush in a circumferential direction of the rail vehicle door leaf frame.

2. The vehicle door leaf frame according to claim 1, wherein:

said two outer frame hollow profiles each having two side walls;

said two inner frame hollow profiles each having a base profile with a longitudinal end section being received between said two side walls of one of said outer frame hollow profiles;

said frame hollow profiles have profile webs which meet one another and/or profile limbs which meet one another and are substantially flush in the circumferential direction of the rail vehicle door leaf frame; and said profile webs which meet one another and/or said profile limbs which meet one another of said frame hollow profiles which meet one another are fitted in a mechanical contact region.

3. A rail vehicle door leaf, comprising:

a rail vehicle door leaf frame, containing:

precisely four frame hollow profiles forming said rail vehicle door leaf frame;

said frame hollow profiles being manufactured from precisely two different hollow profiles;

said frame hollow profiles which meet one another in a corner region of said rail vehicle door leaf frame are plugged into one another;

said frame hollow profiles which meet one another are riveted or screwed to one another in said corner region of said rail vehicle door leaf frame, with a result that a joining method functional principle thereof is based on doubling up of sheet metal;

said frame hollow profiles having precisely two inner frame hollow profiles and precisely two outer frame hollow profiles;

said inner frame hollow profiles being of substantially identical configuration;

said outer frame hollow profiles being of substantially identical configuration;

plug-on seals containing a window seal and door seals including a rear door seal and a front door seal;

two of said frame hollow profiles which meet have a radius in said corner region of said vehicle door leaf frame;

said radius serving as a plug-in lug for one of said plug-on seals;

said outer frame hollow profiles have a radii for at least one of said door seals;

all of said frame hollow profiles in regions which meet one another constitute a radii for said window seal;

said frame hollow profiles have radially outer and front profile webs, all of said radially outer and front profile webs have a substantially completely circumferential seal edge for said front door seal;

said frame hollow profiles have radially outer and rear profile webs and all of said radially outer and rear profile webs have a substantially completely circumferential seal edge for said rear door seal;

said frame hollow profiles have radially inner and front profile limbs and all of said radially inner and front profile limbs have a substantially completely circumferential seal edge for said window seal;

said frame hollow profiles have seal edges including at least one outer and at least one inner seal edge with a grooving formed therein; and said seal edges which meet one another of said frame hollow profiles are substantially flush in a circumferential direction of said rail vehicle door leaf frame.

4. The vehicle door leaf according to claim 3, further comprising:

a thrust plate disposed at least on one side of the vehicle door leaf; and a center strut disposed at least on one side of the vehicle door leaf, said thrust plate and said center strut being set up between said outer frame hollow profiles, being vertical frame hollow profiles, of said rail vehicle door leaf frame.

5. The vehicle door leaf according to claim 4, wherein said thrust plate and said center strut are riveted or screwed to one of said frame hollow profiles at least on one side of the vehicle door leaf, with a result that a joining method functional principle thereof is based on doubling up of sheet metal;

further comprising a sealing compound disposed between said thrust plate and said center strut and at least one of said frame hollow profiles;

wherein said thrust plate, said center strut and said at least one frame hollow profile are coated;

wherein said center strut is riveted or screwed to said thrust plate, with a result that a joining method functional principle thereof is based on doubling up of sheet metal;

wherein said center strut is configured in one piece with said thrust plate;

wherein said sealing compound is disposed between said thrust plate and said center strut; and wherein said rail vehicle door leaf frame itself is of a pressure-tight and a water-tight configuration.

6. A rail vehicle, comprising:

a rail vehicle door leaf frame configured according to claim 1.

7. A rail vehicle, comprising:

a rail vehicle door leaf according to claim 3.

* * * * *